US006152223A

United States Patent [19]

Abdo et al.

[11] Patent Number: 6,152,223

[45] Date of Patent: Nov. 28, 2000

[54] ROD GUIDE

[75] Inventors: Gary E. Abdo, Tulsa, Okla.; J. D. White, Bakersfield, Calif.; Steve Craft, Bakersfield, Calif.; Brett White, Bakersfield, Calif.

[73] Assignee: Norris Sucker Rods, Tulsa, Okla.

[21] Appl. No.: 09/152,987

[22] Filed: Sep. 14, 1998

[51] Int. Cl.[7] ..... E21B 17/10

[52] U.S. Cl. ..... 166/241.4; 175/325.5

[58] Field of Search ..... 166/241.1, 241.2, 166/241.4, 176, 241.6; 175/325.1, 325.5

[56] References Cited

U.S. PATENT DOCUMENTS

| | | | |
|---|---|---|---|
| 735,690 | 8/1903 | Alvord | 166/241.2 |
| 1,527,713 | 2/1925 | Stout | 166/241.4 |
| 1,535,336 | 4/1925 | Nixon | 166/241.4 |
| 1,552,888 | 9/1925 | Smith | 166/241.4 |
| 1,566,586 | 12/1925 | Dodson | 166/241.4 |
| 1,605,316 | 11/1926 | Wilson | 166/241.2 |
| 1,716,247 | 6/1929 | Smith | 166/241.4 |
| 1,875,555 | 9/1932 | Biedermann | 403/206 |
| 1,897,507 | 2/1933 | Morgan | 166/175 |
| 2,153,787 | 4/1939 | Anderson | 166/241.4 |
| 2,162,426 | 6/1939 | Fitzpatrick | 166/176 |
| 2,253,415 | 8/1941 | Brodie . | |
| 2,793,917 | 5/1957 | Ward | 166/241.4 |
| 2,863,704 | 12/1958 | Hillman . | |
| 3,049,382 | 8/1962 | Ell | 166/241.4 |
| 3,106,246 | 10/1963 | Prentiss . | |
| 3,370,894 | 2/1968 | Pourchot | 166/241.4 |
| 3,399,730 | 9/1968 | Pourchot | 166/176 |
| 3,560,060 | 2/1971 | Morris | 166/241.4 |
| 4,088,185 | 5/1978 | Carson | 166/176 |
| 4,099,564 | 7/1978 | Hutchison | 166/241.1 |
| 4,101,179 | 7/1978 | Barron | 175/325.5 |
| 4,105,262 | 8/1978 | Richey | 175/325.2 |
| 4,258,804 | 3/1981 | Richey et al. | 175/325.5 |
| 4,343,518 | 8/1982 | Pourchot | 166/241.4 |
| 4,575,163 | 3/1986 | Sable | 384/29 |
| 4,600,063 | 7/1986 | Beasley | 175/325.5 |
| 4,630,690 | 12/1986 | Beasley et al. | 175/57 |
| 4,640,349 | 2/1987 | Allen | 166/68.5 |
| 4,809,777 | 3/1989 | Sable | 166/241.2 |
| 4,858,688 | 8/1989 | Edwards et al. | 166/241.4 |
| 4,997,039 | 3/1991 | Sable | 166/241.4 |
| 5,115,863 | 5/1992 | Olinger | 166/241.5 |
| 5,119,876 | 6/1992 | Sable | 166/241.2 |
| 5,191,938 | 3/1993 | Sable et al. | 166/378 |
| 5,247,990 | 9/1993 | Sudol et al. | 166/241.3 |
| 5,358,041 | 10/1994 | O'Hair | 166/241.4 |
| 5,487,426 | 1/1996 | O'Hair | 166/378 |
| 5,492,174 | 2/1996 | O'Hair | 166/241.4 |
| 5,613,556 | 3/1997 | Sable et al. | 166/241.4 |
| 5,941,312 | 8/1999 | Vermeeren | 166/378 |

*Primary Examiner*—David Bagnell
*Assistant Examiner*—J. Dougherty
*Attorney, Agent, or Firm*—Head, Johnson & Kachigian

[57] ABSTRACT

A rod guide for a cylindrical rod. The rod guide includes a cylindrical body surrounding and coaxial with the rod. A first pair of opposed fins extends from the cylindrical body, each first fin having a pair of planar sidewalls parallel to each other and parallel to the diameter of the cylindrical body. A second pair of opposed fins, each has a pair of radiused sidewalls wherein each second fin extends outward radially from the cylindrical body to a terminal end with the fin widest at its terminal end.

8 Claims, 2 Drawing Sheets

ROD GUIDE

BACKGROUND OF THE INVENTION

1. Field of the Invention.

The present invention is directed to an improved rod guide for a rod which may be used in downhole applications wherein the rod guide balances the need for maximum fluid flow with the need for maximizing the amount of rod guide fin material available for wear.

2. Prior Art.

Rod guides are used for stabilizing and centralizing sucker rods which are usually long, cylindrical rods used in downhole applications. In one type of application, the sucker rod is reciprocated within a well bore or tubing string to pump oil or other fluids from a reservoir.

The rod itself is usually attached at the surface to a pumping unit. The rod and attached rod guide reciprocate upwardly and downwardly within the tubing string. Oil and other fluid passes upwardly through the gap between the rod and the tubing string to the surface. The rod is subject to various forces during operation, including compression during the down stroke. The rod is prevented from moving sideways or wobbling by the installation of periodic rod guides. The rod guides typically have a number of vanes, fins or blades which extend radially and centralize the rod within the cylindrical tubing. This prevents the rod from wearing or from other damage. Any wear will, thus, occur to the rod guide fins.

The rod guides may be fabricated from various materials, such as synthetic materials which are oil-resistant and resistant to abrasion.

In one known type of procedure, the cylindrical rod is manufactured initially and then the guides are affixed thereto by adhesive bonding. The cylindrical rod may be placed in a two-piece mold having a cavity.

It is desirable to maximize the cross-sectional area which is available for fluid flow of production from downhole toward the surface. Thus, the cross-sectional area of the rod guide fins should be minimized for maximum fluid flow. It is also desirable to maximize the material available for wear to maximize the life of the rod guides. Thus, the cross-sectional area of the fins should be maximized for maximum wear life.

It is also desirable to provide a rod guide that may be molded simply with traditional molds and molding techniques.

By way of example, Biedermann (U.S. Pat. No. 1,875,555) illustrates a rod guide having three fins that are wider at the ends than at the body. The Biedermann guide could not be removed from a traditional two-piece mold without breaking of the mold.

Accordingly, there remains a need for a durable rod guide with an efficient design.

SUMMARY OF THE INVENTION

The present invention is directed to an improved rod guide which operates with and is bonded to a cylindrical rod.

A cylindrical body of the rod guide surrounds the circumference of the rod. The cylindrical body is also coaxial with the rod which passes through the cylindrical opening in the body.

The rod guide includes a first pair of opposed fins or vanes which extend radially from the cylindrical body of the guide. The first fin has a pair of planar sidewalls with each of the sidewalls parallel to each other. The first fin planar sidewalls are also parallel to the diameter of the cylindrical body. Accordingly, each of the first fins has the same width from the base to the terminal end.

The rod guide also includes a second pair of opposed fins. Each of the second fins has a pair of radiused sidewalls. Each second fin extends outward radially from a base of the cylindrical body to its terminal end. Each second fin is widest at its terminal end.

The first pair of fins are oriented 90° radially on the cylindrical body from the second pair of fins.

Each of the first fins and each of the second fins has a radiused face at its terminal end which is similar to the radius of the tubing string or well bore. Each of the fins has a length less than the length of the cylindrical body. Each of the fins has a sloping face which tapers down toward the body.

DETAILED DESCRIPTION OF THE PREFERRED EMBODIMENTS

Figure 1:
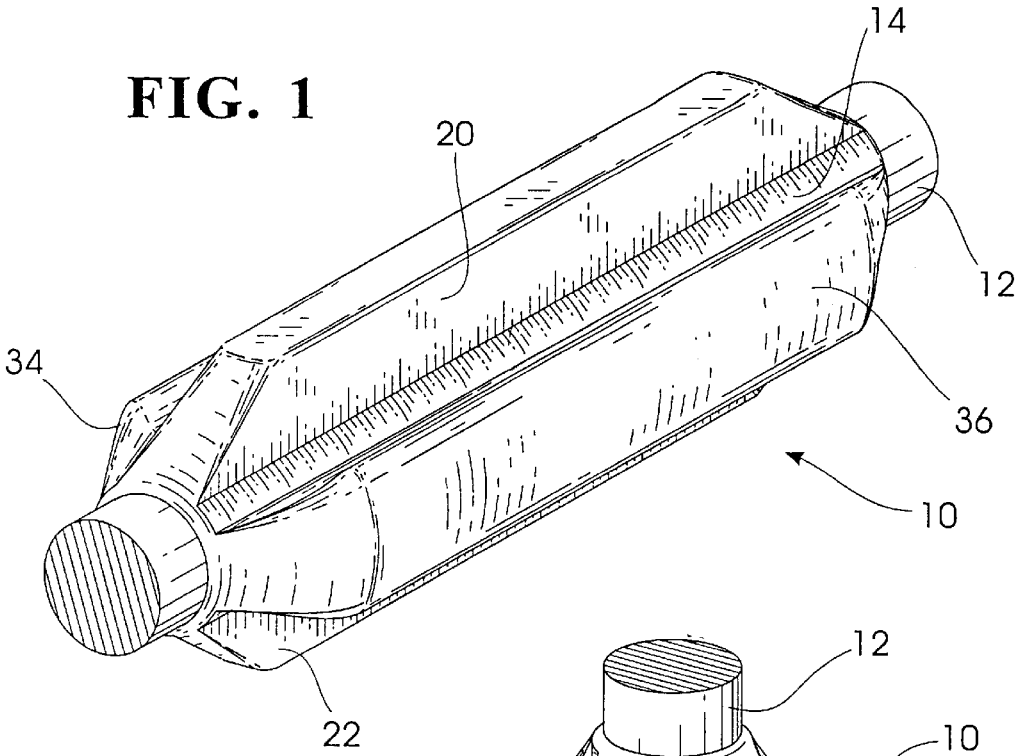
FIG. 1 is a perspective view of an improved rod guide constructed in accordance with the present invention showing a portion of a rod with the balance cut away.
Figure 2:
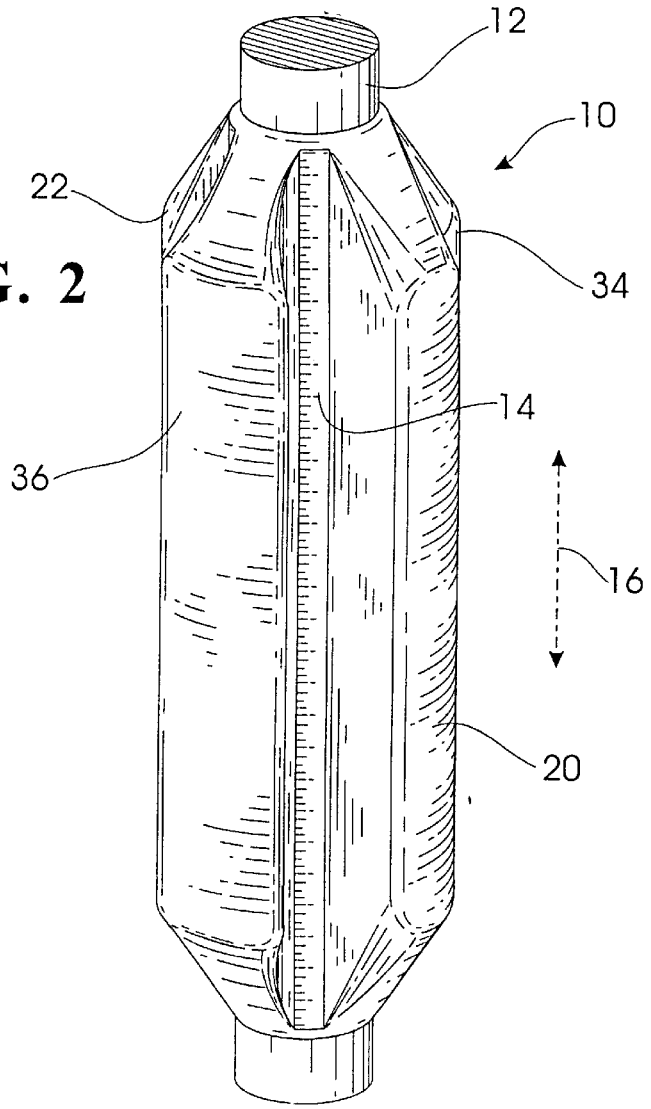
FIG. 2 is a perspective view of the rod guide shown in FIG. 1 in a different orientation.

Referring to the drawings in detail, FIGS. 1 and 2 illustrate perspective views of an improved rod guide 10 constructed in accordance with the present invention. The rod guide 10 operates with and is adhesively bonded to a cylindrical rod 12, a portion of which is visible in FIGS. 1 and 2. The rod 12 extends through the entire length of the rod guide.

In one known application, the rod 12 will extend from the surface downhole to a production area. The rod 12 will reciprocate in the well bore or tubing string. The rod will be powered or driven from the surface and will drive a downhole pump or other tool. Fluid in the production area will be brought to the surface in the space between the rod 12 and a well bore or tubing string (not shown).

A cylindrical body 14 of the rod guide surrounds the circumference of the rod. The cylindrical body 14 is also coaxial with the rod 12 which passes through the cylindrical opening in the body 14.

In operation, the rod guide 10 and rod 12 will be oriented as illustrated in FIG. 2 so that the rod and guide will reciprocate as shown by the arrow 16.

The rod guide 10 also includes a first pair of opposed fins or vanes 20 and 22 which extend radially from the cylindrical body 14.

Figure 3:
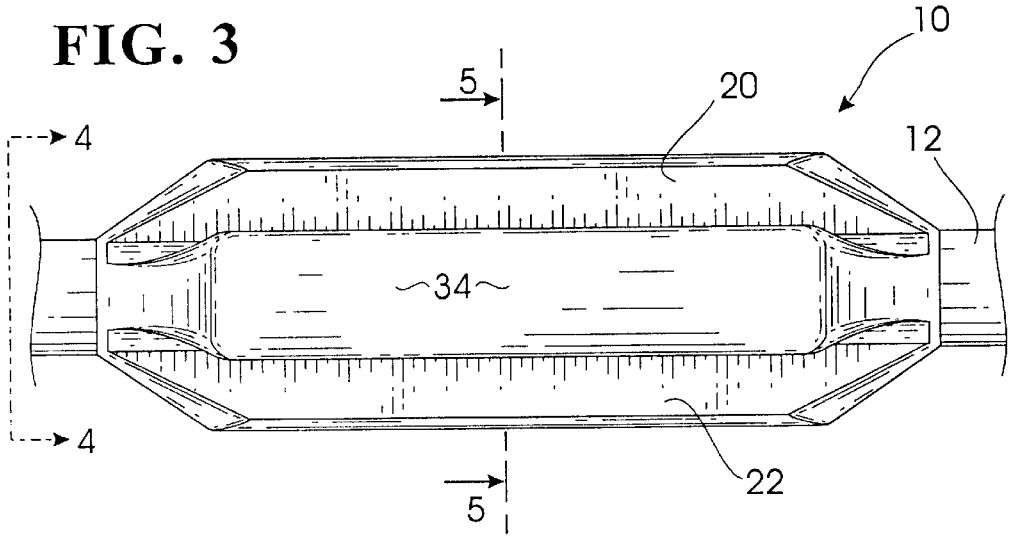
FIG. 3 is a top view of the improved rod guide shown in FIG. 1.

FIG. 3 is a top view of the rod guide 10 wherein both of the first pair of fins or vanes 20 and 22 are visible.

Figure 4:
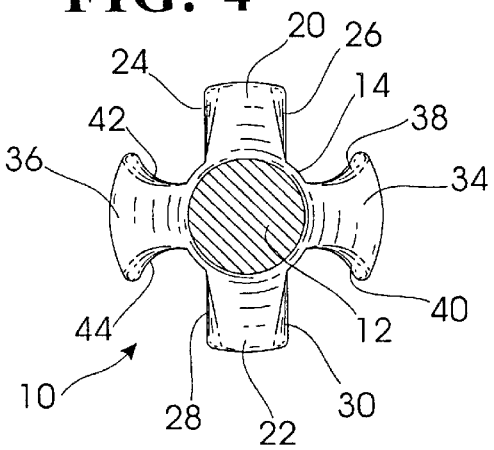
FIG. 4 is a sectional view of the improved rod guide taken along section line 4—4 of FIG. 3.
Figure 5:
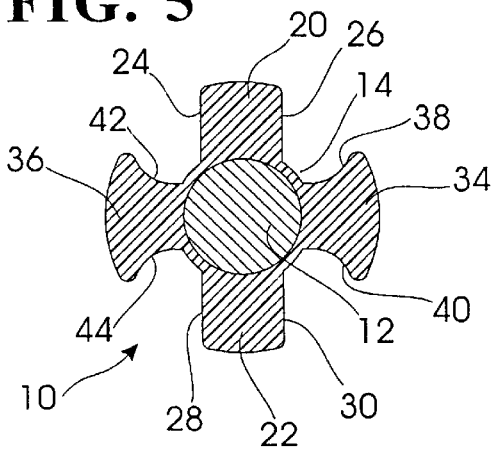
FIG. 5 is a sectional view of the improved rod guide taken along section line 5—5 of FIG. 3.

FIG. 4 is an end view taken along section line 4—4 of FIG. 3. FIG. 5 is a 20 sectional view taken along section line 5—5 of FIG. 3.

As best seen in FIGS. 4 and 5, first fin 20 has a pair of planar sidewalls 24 and 26 with each of the sidewalls parallel to each other. The planar sidewalls 24 and 26 are also parallel to (but not coincident with) the diameter of the cylindrical body 14. Likewise first fin 22 has a pair of planar sidewalls 28 and 30, each sidewall parallel to the other and also parallel to the diameter of the cylindrical body 14. The first fins 20 and 22 thus have the same width from the base to the terminal end.

The rod guide 10 also includes a second pair of opposed fins 34 and 36. Each second fin 34 and 36 extends outward radially from a base at the cylindrical body 14 to its terminal end. Each second fin 34 and 36 is widest at its terminal end. The base of each second fin is narrower than the base of the first fins. Second fin 34 has a pair of radiused sidewalls 38 and 40. Second fin 34 is widest at its terminal end. Likewise, second fin 36 has a pair of radiused sidewalls 42 and 44. Second fin 36 is widest at its terminal end. Each of the second fins 34 and 36 is widest at the point of wear. Thus, there is more volume to wear at the ends of the fins with the enlarged terminal end.

The first pair of fins 20 and 22 is oriented 90° radially on the body from the second pair of fins.

In the spaces between the fins, the oil or other fluid will pass toward the surface.

Each of the first fins 20 and 22 has a radiused face at its terminal end. Likewise, each of the second fins 34 and 36 has a radiused face which is similar to the radius of the tubing string or well bore (not shown).

Figure 6:
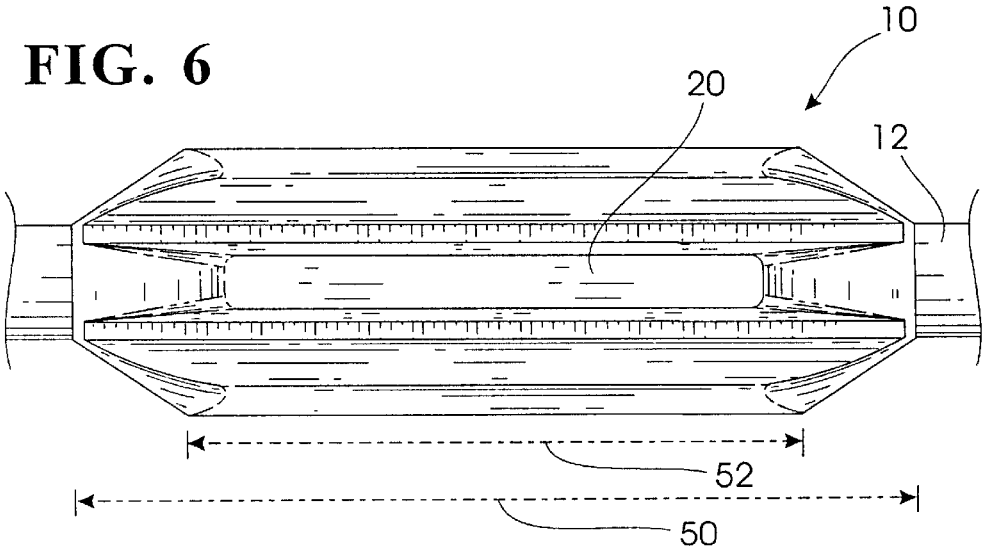
FIG. 6 shows the improved rod guide of the present invention rotated from the FIG. 3 view.

With reference to FIG. 6, it can be seen that the cylindrical body 14 has an axial length illustrated by arrow 50. Each of the first pair of fins 20 and 22 and the second pair of fins 34 and 36 also has a length illustrated by arrow 52. The length of the cylindrical body 14 is greater than the length of the fins. Each of the fins 20, 22, 34 and 36 has a sloping face tapering toward the body 14.

In one method of construction, the rod is placed in a traditional two piece mirror image mold (not shown) having a cavity. The guide material is then poured into the mold where it cures and adheres around the rod. The design of the mold must permit it to be lifted out of the mold. In the present invention, a two piece mold could be used through the diameter of the body 14 and the second fins.

Whereas, the present invention has been described in relation to the drawings attached hereto, it should be understood that other and further modifications, apart from those shown or suggested herein, may be made within the spirit and scope of this invention.

What is claimed is:

1. A rod guide for a cylindrical rod, which rod guide comprises:

a cylindrical body surrounding and coaxial with said rod;

a first pair of opposed fins extending from said cylindrical body, each of said first pair of fins having a pair of planar sidewalls parallel to each other and parallel to the diameter of said cylindrical body; and a second pair of opposed fins, each of said second pair of fins extending outward radially from a base at said cylindrical body to a terminal end, wherein each said second fin is widest at its terminal end and each having a pair of sidewalls which are radiused from said base to said terminal end.

2. A rod guide for a cylindrical rod as set forth in claim 1 wherein each of said second pair of fins has a width at its base less than each of said first pair of fins.

3. A rod guide for a cylindrical rod as set forth in claim 1 wherein said cylindrical body has an axial length greater than said fins and each said fin has a length shorter than said cylindrical body and wherein said fins taper toward said body.

4. A rod guide for a cylindrical rod as set forth in claim 1 wherein each of said first pair of fins and each of said second pair of fins includes a radiused face between said sidewalls.

5. A rod guide for a cylindrical rod as set forth in claim 1 wherein said first pair of fins are oriented 90° radially on said cylindrical body from said second pair of fins.

6. A rod guide for a cylindrical rod as set forth in claim 1 wherein said cylindrical body is bonded to said rod.

7. A rod guide for a cylindrical rod as set forth in claim 1 wherein each said terminal end has a radiused face to mate with an inside diameter of a tubular string.

8. A rod guide for a cylindrical rod as set forth in claim 1 wherein said rod guide is molded of mirror image halves on either side of a parting line which runs through at least one said tapered fins.

* * * * *